US007328592B2

(12) United States Patent
Winterstein et al.

(10) Patent No.: US 7,328,592 B2
(45) Date of Patent: Feb. 12, 2008

(54) CIRCUIT FOR THE GENERATION OF COLD OR HEAT

(75) Inventors: Ralf Winterstein, Dettingen/Erms (DE); Jean-Jacques Robin, Winnenden (DE); Hans Köstler, Rudersberg (DE)

(73) Assignee: Otto Egelholf GmbH & Co. KG, Fellbach (DE)

( * ) Notice: Subject to any disclaimer, the term of this patent is extended or adjusted under 35 U.S.C. 154(b) by 106 days.

(21) Appl. No.: 11/005,116

(22) Filed: Dec. 6, 2004

(65) Prior Publication Data

US 2006/0117792 A1 Jun. 8, 2006

(51) Int. Cl.
*F25B 41/06* (2006.01)

(52) U.S. Cl. ..... 62/527; 62/528; 138/40

(58) Field of Classification Search ..... 62/222, 62/511, 527, 528, 324.6; 138/40, 44, 45
See application file for complete search history.

(56) References Cited

U.S. PATENT DOCUMENTS

| | | | | |
|---|---|---|---|---|
| 1,704,177 | A | 3/1929 | Davenport | |
| 2,576,610 | A | 11/1951 | Kunzog | |
| 2,661,768 | A | 12/1953 | Novak et al. | |
| 2,676,470 | A | 4/1954 | Streitz | |
| 3,815,379 | A | 6/1974 | Scherer et al. | |
| 3,820,571 | A * | 6/1974 | Grier | 138/44 |
| 3,877,248 | A | 4/1975 | Honnold | |
| 3,992,898 | A | 11/1976 | Duell et al. | |
| 4,324,112 | A | 4/1982 | Fujiwara et al. | |
| 4,429,552 | A | 2/1984 | Reedy | |
| 4,653,291 | A * | 3/1987 | Moeller et al. | 62/511 |
| 4,870,821 | A * | 10/1989 | Harada et al. | 60/520 |
| 5,004,008 | A * | 4/1991 | Drucker | 137/504 |
| 5,134,860 | A * | 8/1992 | Drucker | 62/528 |
| 5,170,638 | A * | 12/1992 | Koenig et al. | 62/204 |
| 5,186,021 | A * | 2/1993 | Keller | 62/511 |
| 5,655,571 | A | 8/1997 | Gawlik | |
| 5,862,676 | A | 1/1999 | Kim et al. | |
| 5,893,273 | A * | 4/1999 | Casiraghi | 62/511 |
| 5,966,960 | A * | 10/1999 | Cummings et al. | 62/296 |
| 6,282,903 | B1 | 9/2001 | Russell | |
| 6,510,700 | B1 * | 1/2003 | Lundberg | 62/222 |

(Continued)

FOREIGN PATENT DOCUMENTS

DE 26 27 526 A1 1/1977

(Continued)

OTHER PUBLICATIONS

European Search Report dated Mar. 29, 2006 relating to European Patent Application No. 03028239.6 and English Translation thereof.

(Continued)

*Primary Examiner*—Mohammad M. Ali
(74) *Attorney, Agent, or Firm*—Amster, Rothstein & Ebenstein LLP

(57) ABSTRACT

A circuit for the generation of cold or heat comprising a compressor, an evaporator, a condenser and a restriction member made as a separate component and having a fixed throughflow cross-section, with the restriction member being inserted directly between two elements of the circuit such as a connection tube and a connection stub to reduce the manufacturing costs and the required construction space.

13 Claims, 1 Drawing Sheet

Figure 1:
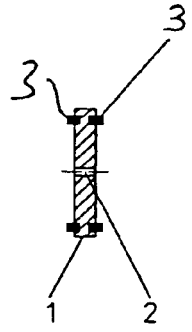

U.S. PATENT DOCUMENTS 6,560,987 B2 * 5/2003 Kreger et al. ..... 62/511

FOREIGN PATENT DOCUMENTS

| | | | |
|---|---|---|---|
| DE | 197 27 440 | A1 | 8/1998 |
| EP | 0 821 210 | B1 | 11/2002 |
| EP | 1 429 090 | A2 | 6/2004 |
| JP | 57-49771 | | 3/1982 |
| JP | 57-108568 | | 6/1982 |
| JP | 10-30741 | A * | 2/1998 |
| JP | 2001-174106 | | 6/2001 |
| JP | 2001-255041 | | 9/2001 |

OTHER PUBLICATIONS

Search Report issued for German Patent No. 102 58 453.2 and English translation thereof.

* cited by examiner

CIRCUIT FOR THE GENERATION OF COLD OR HEAT

The present invention relates to a circuit for the generation of cold or heat comprising a compressor, an evaporator, a condenser and a restriction member formed as a separate component and having a fixed throughflow cross-section.

Restriction members having a fixed throughflow cross-section are used in cold circuits in specific applications. The restriction members are formed, for example, by a copper tube arranged in a housing, with the housing being interposed in the cold circuit at the corresponding position, in particular between the condenser and the evaporator.

It is the underlying object of the invention to improve a circuit of the initially named kind. In particular the manufacturing effort and the manufacturing costs should be removed.

This object is satisfied in that the restriction member is inserted directly between two elements of the circuit such as the connection tube and the connection stub.

A separate housing is saved by the arrangement of the restriction member directly between two elements of the circuit such as the connection tube and the connection stub. Construction space can moreover be saved since the housing is omitted.

The restriction member can be formed, for example, as a disk with a passage opening, in particular a central passage opening, or at least have such a disk as a component. By this disk-shaped form of the restriction member, the latter can be inserted in a suitable manner between two elements of the circuit and can be fixed solely by connecting the two elements. A corresponding shoulder, on which the disk lies, can be provided between the two elements for this purpose. A favorable design thus results in both a constructive respect and with respect to the manufacture.

In accordance with a particularly preferred embodiment of the invention, the restriction member is simultaneously formed as a sealing element to outwardly seal the connection position of the two elements of the circuit. A separate sealing element for the sealing of the two elements with respect to one another can thereby be omitted so that overall at least one further component is saved. An outer leak tightness of the circuit at the connection of the two elements can thus be provided in a cost-favorable and non-complex manner.

To bring about the sealing function of the restriction member, the latter can, for example, have a surface of resilient sealing material. Another possibility consists of inserting at least one resilient sealing element, for example an O ring, into the restriction member.

In accordance with another embodiment of the invention, the restriction member can be made as a metallic seal or have a metallic seal. This embodiment is in particular suitable for high pressures.

In accordance with a further embodiment of the invention, which is likewise particularly preferred, the restriction member be made with a filter function in addition to or alternatively to the sealing function. A separate component can also thereby be saved and the costs can be lowered accordingly.

The restriction member can support a filter screen for this purpose on one side, in particular on the inflow side, to prevent a clogging of the restrictor by contamination particles. The restriction member can, however, also support such a filter screen on both sides, that is both on the inflow side and on the outflow side. A clogging can thus also be prevented from the outflow side on a standstill of the circuit. Operation of the circuit in both flow directions, that is, for example, both as a cold circuit and as a heat pump, can moreover take place by this second embodiment. For this purpose, the restriction member in accordance with a specific embodiment of the invention is made to be flowed through in both directions.

Figure 2:
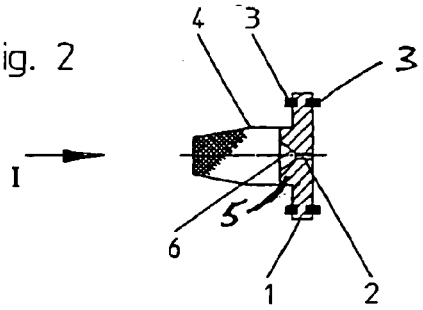
Figure 3:
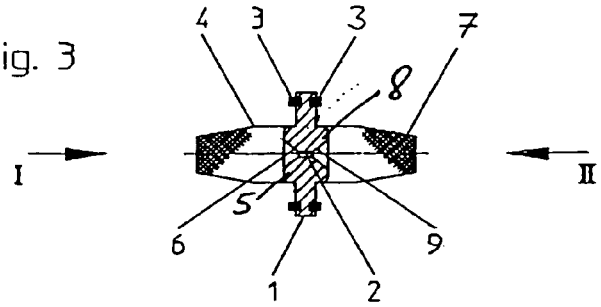
Figure 4:
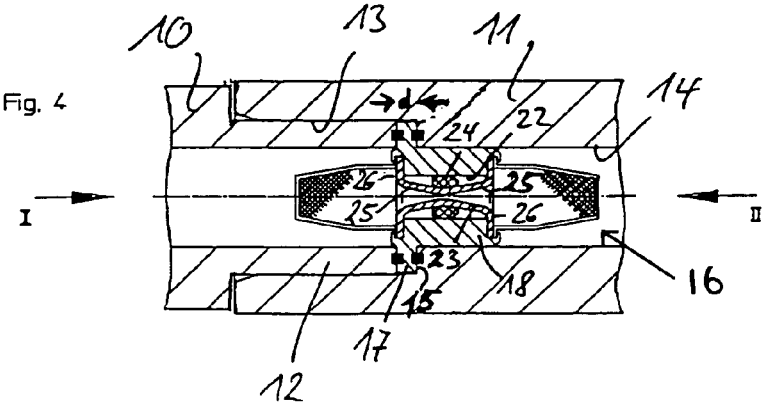

Embodiments of the invention are shown in the drawing and will be described in the following. There are shown, schematically in each case, FIG. 1 a first variant of a restriction member in accordance with the invention;

FIG. 2 a second variant of a restriction member in accordance with the invention;

FIG. 3 a third variant of a restriction member in accordance with the invention; and FIG. 4 a section of a circuit in accordance with the invention with a restriction member.

The restriction member shown in FIG. 1 is made as a disk 1 with a central passage opening 2. The passage opening 2 pre-sets the restriction cross-section and is correspondingly made as required. Two ring-shaped sealing elements 3 are inserted into the disk 1 on both flat sides. Alternatively, the disk 1 could have a surface made of resilient sealing material. The disk 1 can be used as a sealing element by both measures.

For this purpose, the disk 1 is inserted, for example, between two tube ends of the circuit or, for example, between a tube end and a connection stub, with a shoulder being formed at one of the two elements toward which the disk 1 is urged by the end face of the other element, when the two elements are connected to one another. The connection of the two elements can take place, for example, by screwing or by a flange connection.

FIG. 2 shows a variant in which the restriction member additionally has a filter function. For this purpose, a filter screen 4 is arranged on the inflow side of the disk 1 and is made as a basket converging conically against the flow direction I. The disk 1 in this variant is furthermore made with a projection 5 on the inflow side to which the filter screen 4 is secured and which is provided with an inflow funnel 6 tapering conically in the flow direction I for the passage opening 2. As with the variant of FIG. 1, the disk 1 also has a ring-shaped sealing element 3 on each of its two flat sides which is inserted into a corresponding groove so that a triple function is provided here, namely a sealing function and a filter function in addition to the restriction function through the passage opening 2. Instead of the sealing elements 3, the disk 1 could again also be provided with a surface made of resilient sealing material.

The variant shown in FIG. 3 likewise shows a restriction member with an additional filter function. In contrast to FIG. 2, however, filter screens 4, 7 are arranged on both sides of the disk 1. In this manner, a clogging of the passage opening 2 can be prevented both from the inflow side and from the oppositely disposed side or the restriction member can be used for both flow directions I and II.

In this variant, the disk 1 has a respective projection 5, 8 on both flat sides for the securing of the two filter screens 4, 7. Both projections 5, 8 are each provided with an inflow funnel and an outflow funnel 6, 9 respectively for the passage opening 2. In this variant, the disk 1 in another respect also has a respective ring-shaped sealing element 3 on both its flat sides which is inserted into a corresponding groove or it has a surface made of resilient sealing material so that this variant also satisfies a triple function, namely a restriction function through the passage opening 2, a sealing function and a filter function.

FIG. 4 shows a tube end 10 and a connection stub 11 of a circuit in accordance with the invention, with the connection position in particular lying between the condenser and the evaporator. The end of the tube 10 has a section 12 with reduced cross-section which engages into a corresponding opening 13 of the connection stub 11. The opening 13 merges inwardly into an opening 14 with a reduced opening cross-section with respect to the opening 13. A shoulder 15 facing the tube end 10 is thereby formed between the openings 13 and 14.

A restriction member 16 is inserted into the opening 14 of the connection stub 11. It is made in socket shape and is extended in disk form on its side facing the connection tube 10. The disk-like section 17 of the restriction member 16 has a diameter which is slightly smaller than the diameter of the opening 13. The socket section 18 of the restriction member 16 likewise has a diameter which is slightly smaller than the diameter of the opening 14. In this manner, the restrictor member 16 can be inserted into the opening 14 with the socket section 18 and can be supported on the shoulder 15 between the openings 13 and 14.

The thickness d of the disk-like section 17 of the restriction member 16 is moreover selected such that the tube 10 presses the disk-shaped section 17 of the restriction member 16 toward the shoulder 15 with its end 12 in its final installation position. In the embodiment shown, two ring-shaped sealing elements 3 inserted into the two flat sides of the disk-shaped section 17 are thereby compressed. In this manner, a seal can be realized between the disk-shaped section 17 and the support stub 11 and between the disk-shaped section 17 and the section 12 of the tube 10 so that overall the connection position between the tube 10 and the support stub 11 is outwardly sealed. Additionally or alternatively, O rings which are inserted into corresponding grooves of the tube 10 could be provided between the tube 10 and the support stub 11.

The socket section 18 and the disk section 17 of the restriction member 16 are formed with a central passage opening 22 into which a shaped tube 23 is inserted. The tube 23 is surrounded by an O ring 24 in the center which is pressed toward the passage opening 22 by the shape of the tube 23 and thereby seals the tube 23 with respect to the socket section 18 of the restriction member 16.

The tube 23 is shaped such that it forms at the centre, that is in the region of the O ring 24, a passage opening 2 with the desired passage cross-section and, at both sides thereof in each case a respective inlet funnel or outlet funnel 25 for the passage opening 2. The tube 23 is outwardly flanged over at its two ends and lies on the end faces 26 of the restriction member 16. A filter screen 4, 7 made in accordance with FIGS. 2 and 3 is placed onto the flanged over edge of the tube 23 such that the conically tapered closed ends of the filter screens 4, 7 face away from one another. By flanging over the two end faces of the restriction member 16, the two filter screens 4, 7 are fixed on the restriction member 16 together with the tube 23.

To establish a circuit in accordance with the invention in accordance with FIG. 4, a restriction member 16 is introduced into the opening 13, 14 of the support stub 11 such that the section 18 dips into the opening 14 and the disk-like section 17 contacts the shoulder 15. The tube 10 is then introduced into the opening 13 at its section 12 and the tube 10 is connected to the connection stub 11, by a flange connection for example. The disk-shaped section 17 of the restriction member 16 is clamped between the section 12 of the tube 10 and the shoulder 15 such that the circuit is outwardly sealed.

The circuit can now be put into operation. The flow direction can be selected in accordance with arrow I or arrow II since the restriction member 16 is equipped with a screen 4, 7 on both sides. Any dismantling which may become necessary takes place in reverse order.

The restriction member in accordance with the invention can be used in a space-saving manner and is favorable in manufacture. In addition, up to three functions—restriction function, sealing function and screen function—can be realized with it. Further costs and space can hereby also be saved.

REFERENCE NUMERAL LIST

1 disk
2 passage opening
3 sealing element
4 filter screen
5 shoulder
6 inflow funnel/outflow funnel
7 side of 1
8 shoulder
9 inflow funnel/outflow funnel
10 tube
11 connection stub
12 section of 10
13 opening of 11
14 opening of 11
15 shoulder
16 restriction member
17 disk-shaped section
18 socket section
22 passage opening
23 tube
24 O ring
25 inflow funnel or outflow funnel
26 end face of 16
I flow direction
II flow direction
d thickness

The invention claimed is:

1. A circuit for the generation of cold or heat comprising a compressor, an evaporator, a condenser and a restriction member formed as a separate component and having a fixed throughflow cross-section, the restriction member being inserted directly between two elements of the circuit such as a connection tube and a connection stub and being simultaneously formed as a sealing element to outwardly seal the connection position of the two elements of the circuit, wherein the restriction member has a filter screen positioned on a shoulder of the restriction member.

2. A circuit in accordance with claim 1, wherein the restriction member is made at least partly as a disk with a passage opening.

3. A circuit in accordance with claim 1, wherein the restriction member has a surface made of a resilient sealing material.

4. A circuit in accordance with claim 1, wherein at least one elastic sealing element, in particular an O ring, is inserted into the restriction member.

5. A circuit in accordance with claim 1, wherein the restriction member is made as a metal seal.

6. A circuit in accordance with claim 1, wherein the restriction member comprises two sides and a filter screen is positioned on a shoulder of each of the two sides of the restriction member.

7. A circuit in accordance with claim 1, wherein the restriction member can be flowed through in both directions.

8. A circuit for the generation of cold or heat comprising a compressor, an evaporator, a condenser and a restriction member formed as a separate component and having a fixed throughflow cross-section, the restriction member being inserted directly between two elements of the circuit such as a connection tube and a connection stub and being simultaneously formed as a sealing element to outwardly seal the connection position of the two elements of the circuit, at least one of the elements having an opening and at least one of the elements having a shoulder, wherein the restriction member has a socket section and a disc-shaped section and wherein the restriction member is introduced into the opening such that the socket sections dips into the opening and the disc-shaped section contacts the shoulder.

9. A circuit in accordance with claim 8, wherein the restriction member has a surface made of a resilient sealing material.

10. A circuit in accordance with claim 8, wherein at least one elastic sealing element, in particular an O ring, is inserted into the restriction member.

11. A circuit in accordance with claim 8, wherein the restriction member is made as a metal seal.

12. A circuit in accordance with claim 8, wherein the restriction member comprises a filter screen positioned on a shoulder of each of two sides of the restriction member.

13. A circuit in accordance with claim 8, wherein the restriction member can be flowed through in both directions.

* * * * *